United States Patent [19]

Hopkinson et al.

[11] Patent Number: 4,620,423

[45] Date of Patent: Nov. 4, 1986

[54] EXPANSION DEVICES FOR A MULTIZONE HEAT PUMP SYSTEM

[75] Inventors: Harold H. Hopkinson, Manlius, N.Y.; Eiichi Iiyama, Niiza, Japan

[73] Assignee: Carrier Corporation, Syracuse, N.Y.

[21] Appl. No.: 779,894

[22] Filed: Sep. 25, 1985

[51] Int. Cl.[4] ..... F25B 45/00

[52] U.S. Cl. ..... 62/77; 62/160; 62/298; 62/324.6; 62/525

[58] Field of Search ..... 62/324.6, 160, 524, 62/525, 77, 298

[56] References Cited

U.S. PATENT DOCUMENTS 4,487,031 12/1984 Rogers et al. ..... 62/160

FOREIGN PATENT DOCUMENTS 0160042 12/1979 Japan .
0003522 1/1980 Japan .
0082244 6/1980 Japan .

*Primary Examiner*—Ronald C. Capossela
*Attorney, Agent, or Firm*—Dana F. Bigelow

[57] ABSTRACT

In a multizone heat pump system, individual expansion devices are provided in each of the individual refrigerant flow lines coming from the fan coils such that during the heat cycle, expansion of the refrigerant occurs in the individual expansion devices placed in the individual refrigerant flow lines rather than in a common line leading to the outdoor coil, thus preventing backup of refrigerant in any lower elevational coil(s). The expansion devices are individually sized in proportion to the relative sizes of the associated fan coils to prevent refrigerant backup in any larger fan coil(s).

8 Claims, 2 Drawing Figures

EXPANSION DEVICES FOR A MULTIZONE HEAT PUMP SYSTEM

BACKGROUND OF THE INVENTION

This invention relates generally to heat pump systems and, more particularly, to refrigerant expansion arrangements for heat pump systems with multiple fan coil units.

Conventional heat pump systems include the use of an expansion device with each of the two heat exchanger coils. During the cooling cycle the expansion device leading to the indoor coil is active to expand the refrigerant flowing to the indoor coil acting as an evaporator and, during the cooling cycle the other expansion device is active to provide expanded refrigerant to the outdoor coil acting as the evaporator. In either case, the inactive expansion device is effectively removed in the one direction by a bypass circuit. An example of such a system is shown in U.S. Pat. No. 3,992,898 issued to Duell, et al. on Nov. 23, 1976 and assigned to the assignee of the present invention.

A recent development is the so-called multizone heat pump system wherein, rather than having a single indoor or fan coil with a single outdoor coil, a plurality of fan coils are driven from a single outdoor coil. In this way, the fan coils may be selectively located in the various rooms of a building to more effectively meet the heating and cooling distribution needs within the building.

More often than not, the multiple fan coils within a single system are not at the same elevation. That is, while there may be one or more units on the main floor level, there is likely to be one or more units on an upper or lower level. Such an arrangement creates a problem with respect to the flow of liquid refrigerant, since the difference in elevation will tend to reduce the flow of refrigerant from the lower elevational fan coil(s) to thereby reduce their capacity, and possibly render them completely ineffective as the lower coils fill with condensed liquid refrigerant.

Another problem associated with multizone systems is that related to flow rate requirements for different sized fan coils. For example, assuming that the various fan coils are on the same elevational level, if one fan coil is larger than the other(s), it will need to pass a greater volume of liquid refrigerant than the other(s). If its flow volume is restricted to substantially that of the other unit(s), as will be the case where the units are all fluidly connected to a common refrigerant line leading to the outdoor coil, then the liquid refrigerant will tend to build up in the larger coil to thereby reduce its capacity.

It should be recognized that, to some extent, the above mentioned problem with respect to different sized coils will be self correcting. That is, as the liquid refrigerant volume builds up and is therefore elevationally higher in the larger coil, the associated increased pressure at the common points will cause a greater flow rate from that coil to thereby reduce the buildup. However, if the coils are on different elevational levels as discussed hereinabove, the self correcting phenomena may not occur and, in fact, the problem may be made more severe: i.e. where the larger coil is at the lower elevation.

It is therefore an object of the present invention to provide a multizone heat pump system with enhanced refrigerant flow characteristics.

Another object of the present invention is the provision in a multizone heat pump system for easily and efficiently accommodating fan coils at different elevational levels without incurrring differential flow problems.

Yet another object of the present invention is the provision in a multizone heat pump system for easily and efficiently accommodating fan coils of different sizes without incurring differential flow problems.

Yet another object of the present invention is the provision for a multizone heat pump system which is economical to manufacture and extremely functional in use.

These objects and other features and advantages become more readily apparent upon reference to the following description when taken in conjunction with the appended drawings.

SUMMARY OF THE INVENTION

Briefly, in accordance with one aspect of the invention, the single expansion device in the common refrigerant line leading to the outdoor coil, is replaced with a plurality of expansion devices that are installed in the individual lines leading from the associated fan coils prior to their union at the common line. In this way, because of the substantial pressure drop resulting between the individual fan coil lines and the common line to which they are joined, the pressure differences caused by the different elevations becomes insignificant with respect to their effect on flow. That is, the refrigerant flow from the individual fan coils will tend to be equalized such that the lower coil(s) will not tend to be flooded by their condensed liquid refrigerant.

In accordance with another aspect of the invention, the individual expansion devices are sized proportionately to the sizes of their associated fan coils. Thus, a larger expansion device is matched with a larger fan coil to thereby provide for greater volume flow rates. The refrigerant flow rates are thus established to match the volumetric flow rate of the associated fan coils to thereby alleviate the problem of refrigerant buildup in the larger units, In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
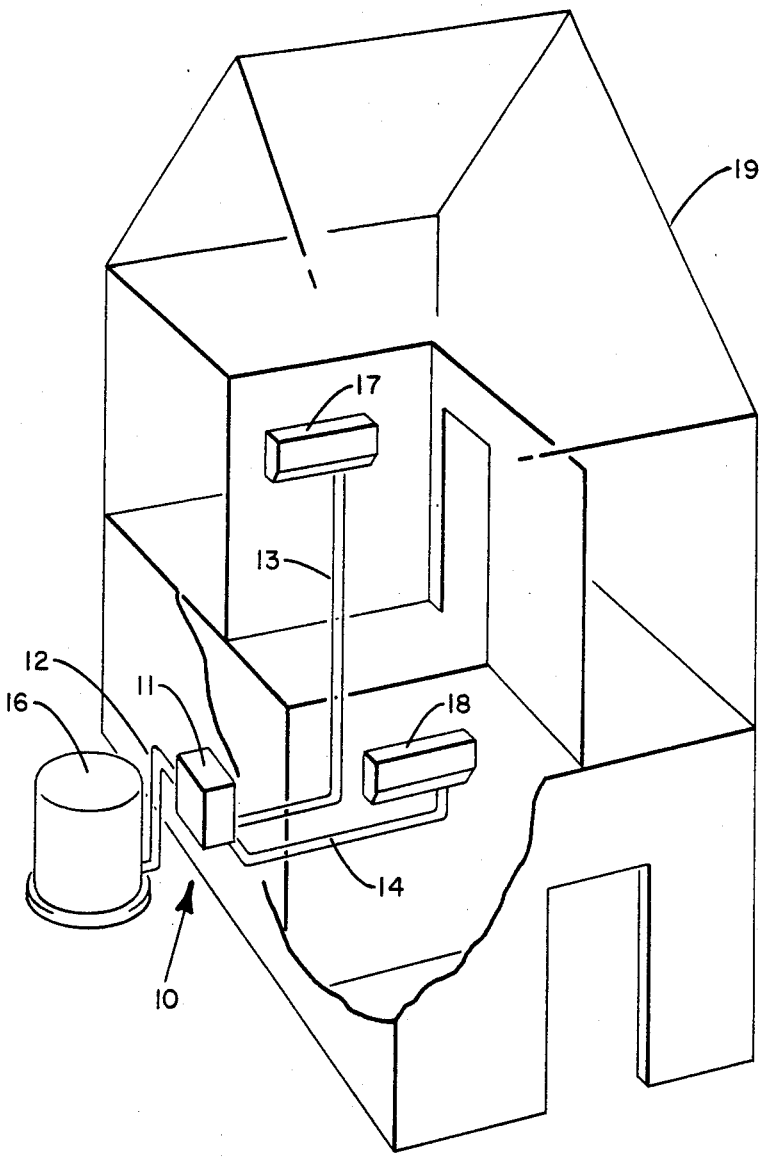
FIG. 1 is a perspective view of an installed multizone heat pump system with the present invention incorporated therein.

Referring now to FIG. 1, the invention is shown generally at 10 as incorporated in a control box 11 which is fluidly and electrically interconnected, by lines shown generally at 12, 13 and 14, between an air conditioning outdoor section 16 and the indoor fan coils 17 and 18. The system is installed in a building 19 where it is desired to have independent control and operation of the individual heating and air conditioning units within the various rooms of the building 19. For example, in the installation as shown, each of the individual fan coils 17 and 18 have their own thermostats (not shown) located in their respective rooms, and the associated fan coils 17 and 18 are responsively operated, independent from each other, to provide heating or cooling to their respective rooms as required to meet the demands indicated by their respective thermostats. Thus, it may be that both of the fan coils 17 and 18 are operating simultaneously in either the cooling or heating mode, or that, while one of the fan coils 17 or 18 is operating in the cooling or heating mode, the other fan coil is turned off.

Aside from the manner of operation as described hereinabove, the fan coils 17 and 18 are of a rather conventional design and include: a refrigerant-to-air heat exchanger coil; a fan to circulate air from the room, across the heat exchanger coil, and back into the room; and a motor to drive the fan.

As will be seen in FIG. 1, the fan coil 17 is located at a higher elevation than the fan coil 18. Such an arrangement is common and desirable in multizone heat pump systems, but is the cause of differential refrigerant flow problems as discussed hereinabove. It is thus one of the design features included in the control box 11 to alleviate the problems associated with the differential elevations.

Another problem addressed by the apparatus within the control box 11 is that of differential fan coil capacities as discussed hereinabove. This occurs, for example, when the fan coil 17 and 18 are placed in different sized rooms or the primary use of the rooms is substantially different. For example, the heating/cooling requirements would be substantially different in (a) a room containing electronic devices such as computers or the like, (b) a kitchen with large ovens, and (c) a family room which is partially below ground level. It is thus desirable to match the size of the individual fan coils with the projected heating/cooling requirements of their particular rooms. The associated problems as discussed hereinabove must then also be addressed.

The outdoor section 16 is of a conventional design and includes a compressor, a heat exchange coil, a fan and drive motor. It will be recognized that the components of the outdoor section 16 must be sized for proper operation with all of the fan coils operating simultaneously, while at the same time being capable of operating with less than all of the fan coils in operation. For example, in a three fan coil system it may be quite common to operate with only one of those fan coils on while the others are effectively removed from the system.

Control for the multizone system is primarily provided by the control box 11 which is shown in FIG. 1 as being installed on the outer side of the building 19, near the outdoor section 16. It should be recognized, however, that this unit and/or the components contained therein may just as well be located within the outdoor section 16 or within the building 19, such as in the garage, a control room, or even between the outer and inner walls of the building.

Figure 2:
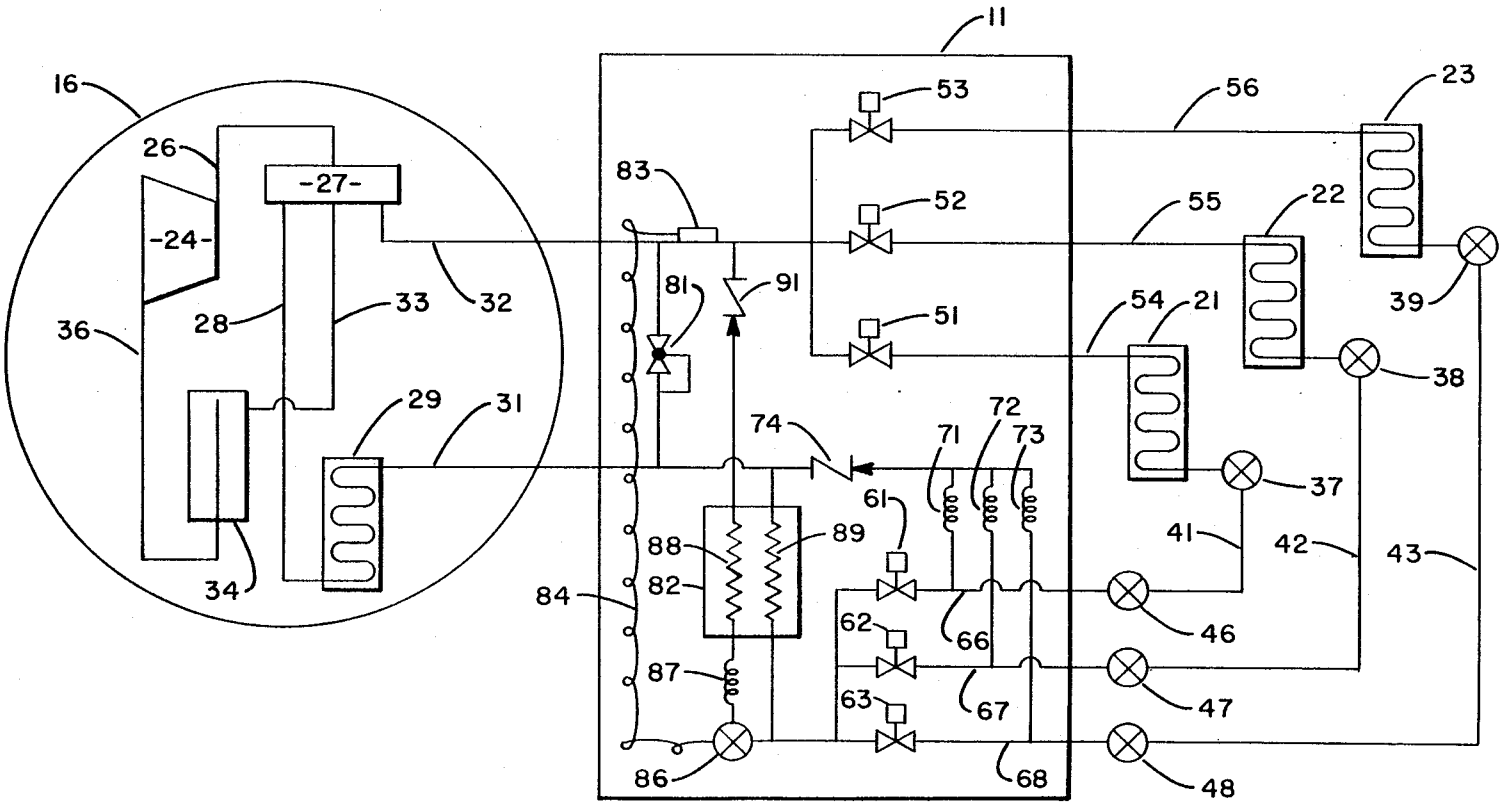
FIG. 2 is a schematic illustration of a multizone heat pump system with a preferred embodiment of the present invention incorporated therein.

Referring now to FIG. 2, there is shown a schematic illustration of the refrigerant flow apparatus and included components of the outdoor section 16, the control box 11, and the indoor fan coil units. While there are three such fan coils 21, 22 and 23 shown as equivalents, in design, purpose, and function, as the fan coils 17 and 18 described hereinabove, there may be more or less such fan coils in any particular installation. Further, although the fan coils 21, 22 and 23 are not pictorially distinguished in relative size or elevation, it should be understood that various sizing and elevational requirements may be imposed on the fan coil array to meet the various installation requirements. The control box 11 and the various components therewithin are designed to accommodate these requirements for variation.

Referring first to the outdoor section 16, the compressor is shown at 24 with its discharge line 26 connected to a four-way valve 27, which is operable in a conventional manner to selectively direct the flow of refrigerant to the outdoor coil or to one or more of the indoor coils to effect the cooling or heating cycle, respectively. Thus, during the cooling cycle the four-way valve 27 directs the flow of refrigerant along line 28 to the outdoor coil 29 where it is condensed, with its liquid passing along line 31, to the control box 11 where it is controlled in a manner to be described hereinafter. Liquid refrigerant is then expanded, passed through one or more of the indoor coils 21, 22 or 23, passed back through the control box 11, and finally returned to the four-way valve 27 by way of the return line 32. The refrigerant then passes along line 33 to the accumulator 34 and finally along the suction line 36 back to the compressor 24.

During the heating cycle, the four-way valve 27 passes the high pressure refrigerant along line 32 to the control box 11 where it is controlled in a manner to be described hereinafter, and then to one or more of the indoor coils 21, 22 or 23 where it is condensed to provide heat to the internal spaces. The resulting liquid refrigerant is then expanded and passed through the control box 11 for proper control. It then passes along line 31 to the outdoor coil 29 where it is evaporated, with the superheated vapor passing along line 29 to the four-way valve 27, then along line 33 to the accumulator 34, and finally along line 36 back to the compressor 24.

In either the cooling or heating mode as described hereinabove, it is necessary, in conventional refrigeration cycle operation, that the refrigerant be expanded during its flow between the condenser coil and the evaporator coil. Traditionally this function has been accomplished with various expansion devices such as capillary tubes or orifice plates. A more recently used expansion device has been that of the so-called "accurator" which is shown and described in U.S. Pat. No. 3,877,248 issued to F. J. Honnold on Apr. 15, 1975 and assigned to the assignee of the present invention. A later variation on this device is the so-called "bypass accurator", which is shown and described in U.S. Pat. No. 3,992,898 issued to R. J. Duell, et al. on Nov. 23, 1976 and assigned to the assignee of the present invention. It is preferably such a bypass accurator which is used for the expansion devices in the present invention, both for the cooling and heating modes of operation.

For expansion during the cooling mode, these expansion devices 37, 38 and 39 of the type mentioned above are placed in the respective lines 41, 42 and 43, just upstream from the respective fan coils 21, 22 and 23 as shown. When the flow reverses during the heating cycle, the expansion devices 37, 38 and 39 act in the bypass mode to effectively remove their expansion component from the circuit. The expansion process during the heating cycle is then accomplished by the expansion devices 46, 47 and 48 which are placed in the respective lines 37, 38 and 39 just upstream from the control box 11 as shown.

It should be mentioned, that for the heating cycle of such a split system, the expansion device is conventionally placed similar to the expansion devices for the cooling cycle as shown, just upstream from the evaporator coil, i.e. in line 31 just upstream from the outdoor coil 29. However, in order to address the problem mentioned above, i.e. the reduction of flow of refrigerant from one or more of the fan coils 21, 22 or 23 when it is placed in a position of lower elevation than one or more of the other coils, the expansion process is accomplished in the individual lines 41, 42 and 43 prior to the coming together of the individual lines into a common line. In this way, because of the substantial pressure drop at the expansion devices 46, 47 and 48, there will be no significant reduction of flow from the lower elevation coil(s).

Recognizing the second problem as discussed hereinabove, i.e. that of required differential flow rates because of one or more of the fan coils 21, 22 and 23 being larger than the other(s), a further adaptation must be made. That is, while the placement of the expansion devices 46, 47 and 48 into the individual lines 41, 42 and 43 will solve the problems caused by elevational differences, it will tend to exacerbate the problems associated with differential coils sizes. To be more specific, because of the large pressure drop at the expansion devices 46, 47 and 48, it is at these points that the flow rates will be controlled, and the self-correcting feature, i.e. of the larger coil(s) having a greater head and therefore a greater flow, will be essentially lost. The solution found for solving this problem has therefore been to vary the size of the expansion devices 46, 47 and 48 in direct proportion to the size of the respective fan coils 21, 22 and 23. Thus, a larger fan coil will have a larger associated expansion device to thereby permit greater flow rates than its smaller counterparts, thereby preventing refrigerant backup in the larger unit(s). With the use of the accurator type expansion devices, this sizing step can be easily accomplished by simply choosing the insert pistons having the proper orifice size to match the size of the associated fan coil. For example, fan coils having capacities of 6,000, 8,000 and 13,000 BTU/hr. will be matched with orifices having diameters of 0.036", 0.037" and 0.040", respectively.

To understand the variable operational features of the system, the components and functions of the control box 11 will now be described. It will be understood that, in order to accomplish the objectives of the multizone heat pump system, it is necessary to be able to shut down, or effectively remove from the system, any one or more of the fan coils while permitting the other fan coil(s) circuit to operate in a normal manner. This is true for both the heating and cooling cycles. Such a shutting down function is accomplished with the use of solenoid valves 51, 52 and 53 connected by respective lines 54, 55 and 56 to the fan coils 21, 22 and 23 on the one side and by solenoid valves 61, 62 and 63 connected by respective lines 66, 67 and 68 to the expansion devices 46, 47 and 48 on the other side. When, for example, the room in which the fan coil 23 is installed reaches the desired temperature as determined by its associated thermostat, while the temperatures in the room associated with fan coils 22 and 21 have not yet been satisfied, the control circuitry will automatically close the solenoid valves 53 and 63 to thereby effectively remove that portion of the circuit from the system. Subsequently, and in a similar manner, the solenoid valves 52 and 62 will eventually be automatically closed to shut down the fan coil 22 and the solenoid valves 51 and 61 will be automatically closed to shut down the fan coil 21. During that time period, the solenoid valves 53 and 63 may or may not be opened to bring the fan coil 23 back into operation. Thus, in a system with three fan coils, there may at any time be anywhere from 0 to 3 fan coils in operation with the particular combination being frequently varied.

While in principle the solenoid valves completely isolate their associated fan coil when the valves are in the off position, in practice there will be some leakage from the high pressure side and, over extended periods of time, that leakage can be substantial. For example, if, in the summertime, one room is not being used and its thermostat is therefore set at a high threshold temperature to prevent its fan coil from operating, while at the same time the other coils are periodically operational in the cooling mode there will be leakage of refrigerant from the high pressure side of the turned off solenoid valve, with the refrigerant flowing into the unused coil. There is, therefore, a removal of refrigerant from the active system to thereby lower the efficiency, but more importantly, there will be removed from the system a quantity of lubricant which settles from the stored refrigerant in the non-used coil, a condition which is undesirable because of its deprivation of required lubricant to the compressor 24.

During the cooling cycle, the problem of undesirable lubricant storage is alleviated by the use of suction valves 51, 52 and 53 with built in bypass features to allow for bleed-down of refrigerant and suspended lubricant back into the system. Such a valve is commercially available from the Sporlan Valve Co. as a Pilot Operated Solenoid Valve, Part Number CE9S240. In operation, when the leakage pressure in the fan coil reaches a predetermined threshold level, the bypass valve opens and allows refrigerant to re-enter the system via line 32.

During the heating cycle it is the solenoid valves 61, 62 and 63 on the liquid side which would provide the bypass feature to allow the trapped refrigerant to re-enter the system. However, because of the relatively smaller valves that are required in this location, and because of the liquid nature of the refrigerant at this point, the automatic bypass feature is not available. Accordingly, it is desirable to provide bleed-down capillary tubes 71 72 and 73 for interconnecting respective lines 66, 67 and 68 to the common line 31 by way of a check valve 74. The capillary tubes 71, 72 and 73 act in a manner similar to the bypass valves mentioned above to allow the pumpdown into the system of refrigerant tending to accumulate in any unused coil(s). The check valve 74 acts to isolate the capillary tubes 71–73 during the cooling cycle.

One of the characteristics of a multizone system is that of a mismatch of outdoor and indoor coil capacities when only a portion of the fan coils are being used. For example, during periods when the fan coils 21 and 22 are shut down and the fan coil 23 is operating in the heating mode, the active condenser surface is reduced by two thirds from full capacity operation. The resulting effect is to cause an increase in the discharge pressure in line 26 of the compressor 24. If some provision is not made to reduce that pressure, the high pressure control switch will be automatically activated to shut down the system. Accordingly, a hot gas bypass valve 81 is provided to interconnect the lines 32 and 31 as shown in FIG. 2. The valve 81 is a pressure regulated, single direction valve which senses the pressure in the low pressure side at line 31 to bleed back the high pressure side liquid to the low pressure side when the threshold pressures are reached. This bypassing of a portion of the refrigerant around the single fan coil 23 allows the compressor discharge pressure to remain at a reasonable level during periods of single fan coil operation.

During the cooling cycle, when the fan coils 21 and 22 (for example) are shut down and the fan coil 23 is operating as an evaporator there is again a reduction of active fan coil capacity. The effect in this mode, however, is to cause the active operating coil 23 to operate in a highly superheated condition. This, in turn, will cause the compressor to lose suction in line 36. Such a condition can, of course, be somewhat alleviated by the use of a bypass valve similar to the valve 81 described hereinabove, to simply bleed a portion of the liquid from line 31 back into the low pressure line 32. An improvement over that approach is to use a thermocharger 82 as shown in FIG. 2. The thermocharger 82, which is of the type shown in U.S. Pat. No. 4,316,366 issued to John D. Manning on Feb. 23, 1982 and assigned to the assignee of the present invention, has a remote sensing bulb 83 to sense the pressure in the low pressure line 32 and to transmit that pressure along line 84 to operate the thermal expansion valve 86. The thermal expansion valve 86 is connected to the thermocharger 82 by way of a capillary tube 87. The thermocharger 82 has heat exchanger coils 88 and 89 contained therein, in heat exchange relationship. Interconnected between the heat exchanger 88 and the line 32 is a check valve 91 to prevent flow of refrigerant into the thermocharger 82 during the heating cycle.

In operation, during the cooling cycle the refrigerant will pass from line 31 and through the heat exchange coil 89 before going to the fan coil(s) for evaporation. During periods when a single fan coil 23, for example, is in operation, the extent of the superheating condition will be sensed by the remote sensor 83 and when the pressure in line 32 reaches a predetermined level the thermal expansion valve 84 will be responsively opened. This will, in turn, cause a portion of the high pressure liquid refrigerant to be bled off from the line 92 to flow through the capillary tube 87, through the heat exchange coil 88, and be dumped back into the low pressure line 32 by way of the check valve 91. One resulting effect is to maintain the suction in line 26 going into the compressor 24 because of the liquid coolant that is being flashed off to the low pressure side 32. Another effect is to increase the efficiency of the operating fan coil 23 by subcooling the liquid refrigerant passing through the heat exchanger coil 89. In other words, the flashing off of the liquid refrigerant passing through the coil 82 tends to cool the refrigerant passing thereby in counterflow manner in the coil 89 such that there is an increase in the flow of refrigerant through the expansion device 39. An efficiency increase is therefore obtained, while at the same time, the suction to the compressor 24 is being maintained by the dumping of liquid refrigerant to the low pressure side.

It will be understood that the present invention has been described in terms of a preferred embodiment, but may take on any number of other forms while remaining within the scope and intent of the invention.

What is claimed is:

1. An improved heat pump system of the type having a single outdoor coil and multiple indoor coils comprising:

a plurality of individual refrigerant flow lines fluidly connected at their one ends to respective individual indoor coils and at their other ends to a common refrigerant flow line fluidly connected to the outdoor coil; and a refrigerant expansion device in each of said individual refrigerant flow lines, each of said expansion devices being operable when the system operates in the heating mode to receive liquid refrigerant from its respective outdoor coil and cause at least a portion of the refrigerant to expand to a vaporous condition.

2. An improved heat pump system as set forth in claim 1 and further, wherein the size of each of said expansion devices is proportionately matched with the relative size of its respective indoor coil.

3. In a heat pump system of the type having a single outdoor heat exchange unit and a plurality of indoor heat exchanger units comprising:

a plurality of refrigerant flow lines with each being connected at their one end to one of the plurality of indoor heat exchange units for carrying the entire flow of liquid refrigerant from said indoor heat exchange unit during periods of operation in the heating mode, and being connected at its other end to a common refrigerant flow line which fluidly interconnects with the outdoor coil; and a plurality of refrigerant expansion devices, with each being disposed within one of said plurality of refrigerant flow lines.

4. The heat pump system as set forth in claim 3 wherein said plurality of indoor heat exchanger units are of varying size and further wherein said plurality of refrigerant expansion devices are relatively sized in proportion to the relative size of their corresponding heat exchanger units.

5. A heat pump system of the type having a plurality of indoor coils, with each indoor coil being connected by an individual refrigerant flow line to a common line leading to an outdoor coil comprising:

an expansion device provided in each of the individual refrigerant flow lines to provide controlled expansion of refrigerant as it flows from the associated indoor coil to the common line.

6. A heat pump system as set forth in claim 5 wherein said expansion devices are sized in proportion to the relative sizes of their associated fan coils.

7. An improved method of installing a heat pump system having a single outdoor coil and multiple associated indoor coils comprising the steps of:

providing an individual refrigerant flow line between each of the multiple indoor coils and a common refrigerant flow line;

fluidly connecting said common refrigerant flow line to the indoor coils; and providing in each of said individual refrigerant flow lines a refrigerant expansion device capable of receiving liquid refrigerant from the associated indoor coil and expanding at least a portion of the refrigerant to a vapor to be carried by said common refrigerant flow line to the outdoor coil.

8. The method as set forth in claim 7 and including the step of sizing the refrigerant expansion devices in proportion to the relative sizes of their respective fan coils.

* * * * *